United States Patent [19]

Luxford

[11] 3,937,318

[45] Feb. 10, 1976

[54] BILLET ORIENTATION SYSTEM

[75] Inventor: Ronald William Alexander Luxford, Queensland, Australia

[73] Assignee: CSR Limited, Sydney, Australia

[22] Filed: Apr. 18, 1974

[21] Appl. No.: 461,910

[30] Foreign Application Priority Data

Apr. 26, 1973 Australia ..... 3084/73

[52] U.S. Cl. ..... 198/287; 198/57

[51] Int. Cl.[2] ..... B65G 47/14

[58] Field of Search ..... 221/160, 161, 162, 167, 221/172, 173, 266, 277; 198/251, 252, 257, 263, 287, 54, 56, 57, 58, 62, 63, 267, 285, 283

[56] References Cited

UNITED STATES PATENTS

| | | | |
|---|---|---|---|
| 1,490,945 | 4/1924 | Smith | 198/62 X |
| 2,126,425 | 8/1938 | Thompson et al. | 198/56 X |
| 2,977,004 | 3/1961 | Soos | 198/58 X |
| 3,053,296 | 9/1962 | Urschel et al. | 198/287 X |
| 3,292,766 | 12/1966 | Leibelt | 198/56 X |
| 3,367,475 | 2/1968 | Predmore et al. | 198/287 X |
| 3,638,792 | 2/1972 | Bilocq | 198/54 X |
| 3,677,390 | 7/1972 | Parker et al. | 221/173 X |
| 3,721,329 | 3/1973 | Turner et al. | 198/56 X |
| 3,779,422 | 12/1973 | Mori et al. | 221/160 X |
| 3,830,357 | 8/1974 | West et al. | 198/54 |

*Primary Examiner*—Evon C. Blunk
*Assistant Examiner*—Richard K. Thomson
*Attorney, Agent, or Firm*—Henry M. Bissell

[57] ABSTRACT

A method of, and an apparatus for, uniformly orientating elongated billets of sugar cane or the like having lengths within a pre-determined range of lengths and falling under the influence of gravity in a randomly orientated stream of billets are provided.

4 Claims, 13 Drawing Figures

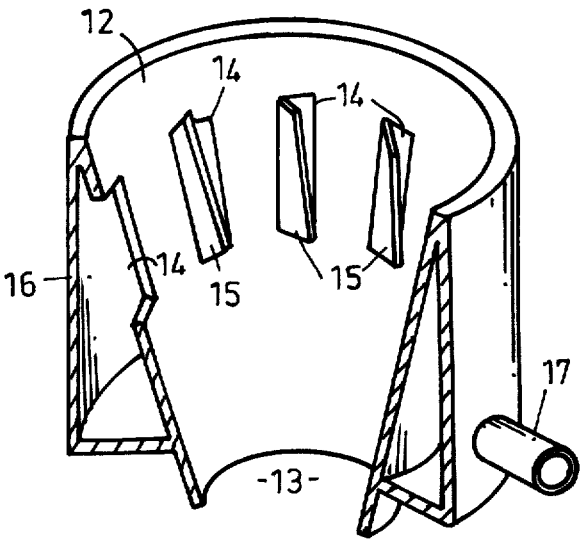
FIG. 4.
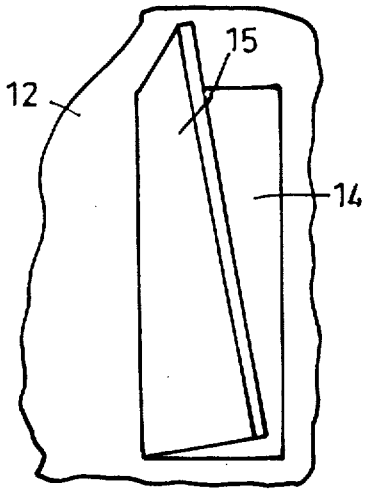
FIG. 5.
FIG. 6.
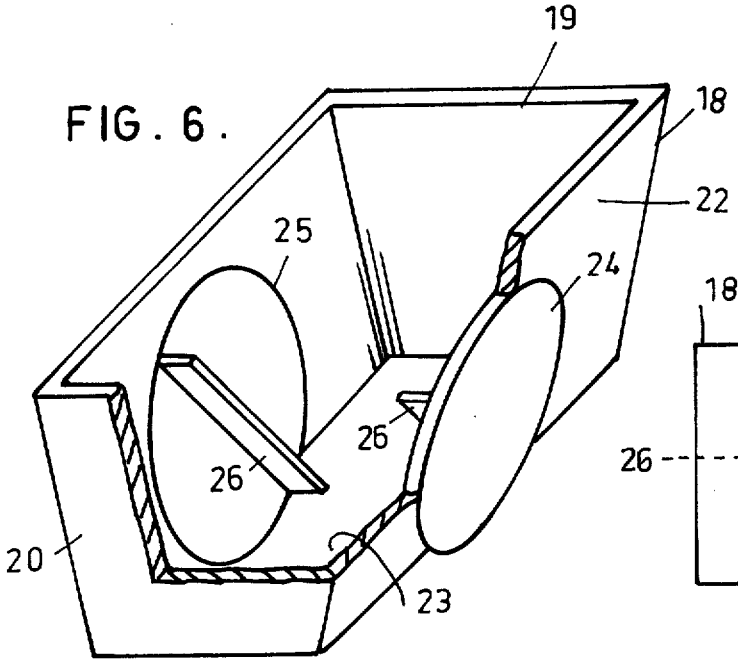
FIG. 7.
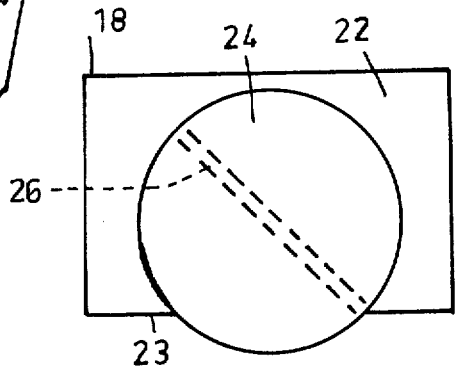

BILLET ORIENTATION SYSTEM

The present invention relates to the mechanical harvesting of sugar cane and other like crops.

In such harvesting individual cane stalks are cut from the stools and each stalk is further cut into small pieces known as billets; the billets then being transferred to a bin adjoining the harvester.

In the known art these billets are transferred to the bin by means of a delivery chute positioned above the bin; the arrangement being such that the billets fall in a random manner into the bin.

The above arrangement however delivers the billets into the bin in such a manner as to give rise to several problems; these problems being dependant on the fact that the billets so delivered form a random tangled pile. Thus, when it is necessary to discharge the billets from the bin, the billets do not discharge smoothly but form clumps and clusters. Further, in certain types of bin, the tangled pile gets caught in the bin itself and the discharge is thereby severely disrupted.

An even more significant problem resulting from the fact that the billets are in a random tangled pile is the loss of effective carrying capacity of the bin as the pile often contains more empty space than billets. This loss in effective carrying capacity means that either the bins have to be discharged more frequently or that more bins than necessary have to be employed.

In its broadest aspect the present invention overcomes the above problems by a method of and apparatus for orientating the billets as they fall into the bin such that they do not form a random tangled pile but are orientated in an organized manner, depending on the shape of the bin, to reduce the empty space between adjoining billets.

In one embodiment of the invention the billets are orientated to lie with their axes horizontal such that adjoining billets are effectively parallel. Many other orientations are however possible; for example, the billets can be effectively parallel with their axes vertical or inclined at an angle to the vertical. Another example is provided by the case in which the billets are orientated to lie with their axes at right angles to and radiating from a central vertical line. Yet another example is provided by the case in which the billets are orientated to be parallel to the surface of a cone. From the above examples it is seen that the billets are said to be orientated when they lie with their axes effectively in a plane or curved surface, and the effectiveness of this orientation is at a maximum when the average distance between adjoining billets is at a minimum.

From the above examples it is seen that the actual orientation required will depend on the shape of the preexisting bin and possibly on the manner in which the bin is to be discharged. Thus, if the bin is circular the orientation of the axes could be radial; if the bin has a sloping end wall the orientation of the axes could be in planes parallel with this wall; and if the bin is conical the billet axes will be orientated to lie in conical planes evenly spaced from the sides of the bin.

Broadly the present invention achieves the required orientation of the billets by operating on the billets as they fall in a random stream through an orientation system. This system has an input region into which the random stream of billets enter, at least one output region from which orientated billets emerge, and orientation means situated therebetween.

In a particular embodiment, the orientation system comprises a hopper constructed as a hollow tube having at one end an input opening and at the other end an output opening. The sides of the tube may be either flat or curved. The tube can have any cross-sectional size and shape and the cross-section need not be constant throughout the length of the tube. The actual shape and dimensions of the tube will depend on the bin shape and the type of orientation required. In one preferred embodiment, hereinafter described in greater detail, the tube has four flat sides and a rectangular cross-section. The tube walls are sloped so that the cross-sectional area decreases from the input opening to the output opening.

While the above embodiment suggests that the system requires material walls, this is not necessarily so since the system can be formed by streams or blasts of air so arranged to form a vortex that compresses the stream of falling billets and at the same time orientates the billets so that their axes are parellel to the axis of the vortex. This embodiment has the advantage that the air blast also serves to remove trash that is generally associated with the billets and consequently this embodiment eliminates the usual trash removal means.

The orientation means operates by applying impulsive energy to the ends of the falling billets so that the billets are orientated into the desired direction. This impulsive energy can be applied directly to all billets requiring orientation; or alternatively the impulsive energy can be applied directly to some billets only and these billets in turn transmit the energy to the remaining billets in the falling stream. An understanding of the alternative application is provided by the observation that the billets in the falling stream form a statistical ensemble having rotational velocities whose directions and magnitudes are randomly distributed. If now into such a statistical ensemble an impulsive energy is transmitted from a constant direction then the directions of the rotational velocities will no longer be randomly distributed but will be orientated in a preferred direction.

The impulsive energy can be supplied by either an active energy source or a passive energy source. In the case of the active energy source the energy source itself moves, for example, the active energy source is a blast of air or a moving director. Such an active source adds energy to the statistical ensemble. In the case of the passive energy source the energy source is fixed and obtains its orientating energy from the falling billets. The passive source is a fixed director surface and when a billet strikes this surface the energy of the billet is transmitted to the surface which in turn, according to the law of action and reaction, transmits the energy back to the billet in a direction that is related to the direction of the director surface. The passive source subtracts energy from the statistical ensemble.

The impulsive energy can of course be supplied by a combination of active and passive sources. Such a combination is a pair of rotating vanes and a pair of sloping plane walls.

Generally the direction of the impulsive energy transmitted by a moving director will depend on the direction of movement of said director; however, the director may of course incorporate some of the attributes of a passive energy source. For example a wall bounding the falling stream of billets may oscillate in some prescribed fashion.

There are many possible forms for the moving directors. Generally they are arms or vanes that either move into the periphery of the falling stream of billets or alternatively move through said stream. The moving directors are of course characterized mainly by the manner in which they move; for example, they can have unidirectional motion in a line, they can have oscillating motion in a line, they can rotate about an axis and they can combine both rotational and linear motions. Linear motion could for example be provided by a flexible belt and in this case the moving directors consists of vanes attached to and projecting from this belt. Rotational motion may be provided by a wheel or disc having vanes projecting radially from the circumference of the wheel or disc.

Another form of a rotational director is provided by a vane operating in a manner similar to that of a car wind shield wiper.

The system can consist of more than one moving director and in an embodiment to be described hereinafter a first moving director is positioned above a second moving director such that the falling billets are sequentially orientated by these directors.

From the above general description it is obvious that there are many possible forms of the orientation system and the actual form used will be chosen to produce the desired result bearing in mind both the shape of the hopper and the boundary conditions imposed by the geometry of the particular mechanical harvester to be used.

One such boundary condition is exemplified in the case where the orientation system works in close conjunction with an air-blast trash removal means such as a fan and in this case the system must not significantly impede the air flow to such means. In such a case where the system includes a hopper one way to minimize any impedance to the air flow is for the hopper to be perforated. Another way as indicated earlier is for the system to contain an air blast active energy source.

Other boundary conditions result from the particular application in which the system includes a hopper mounted at the discharge end of a mechanical harvester. These boundary conditions are as follows. The hopper must be reasonably light; the hopper must be simple, choke free and able to operate unattended; the hopper must be compact as there is limited space available between the harvester discharge and the cane bin; the hopper must be relatively inexpensive; the hopper must be able to handle quantities of cane billets in excess of one ton per minute; and the hopper must allow billets to be spread to the front and rear of the bin.

To further aid in meeting this last boundary condition a swivelling chute may be positioned below the output opening of a hopper such that the chute spreads the horizontally orientated billets from the front to the rear of the bin.

In yet another embodiment described in greater detail hereinafter the system includes an oscillating bundler paddle positioned below a hopper such that bundles of orientated billets are alternatively delivered to the front of the bin and to the rear of the bin.

Power to operate the above described system can be supplied by any suitable means such as electric motors, internal combustion engines or hydraulically operated mechanisms. Hydraulic operation is preferred as it was found that such operation could be conveniently incorporated into the existing harvester hydraulic circuits.

In order that the invention may be clearly understood and carried into effect, the prefered embodiment is given to fully describe the invention and a number of examples are given to illustrate the scope of the invention. The preferred embodiment and the examples are described with reference to the accompanying drawings in which:

FIG. 4 is a perspective view of the orientation apparatus of an example, a part of the apparatus being cut away to reveal the interior.

FIG. 5 is a view of a portion of the apparatus of FIG. 4.

FIG. 6 is a perspective view of the orientation apparatus of an example, a portion of the apparatus being cut away to reveal the interior.

FIG. 7 is a side elevation of the apparatus of FIG. 6.

Figure 1:
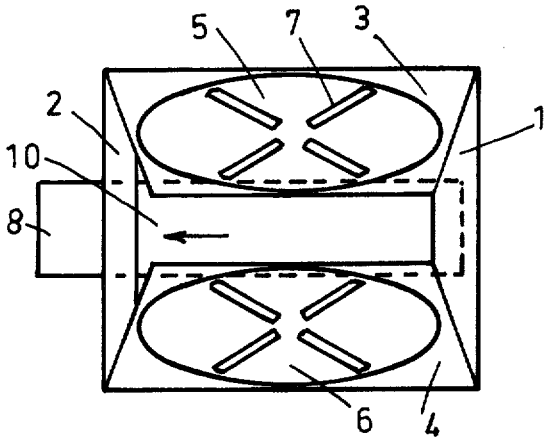
FIG. 1 is a plan view of the orientation apparatus of the preferred embodiment as viewed from above where billet discharge is to the left.
Figure 2:
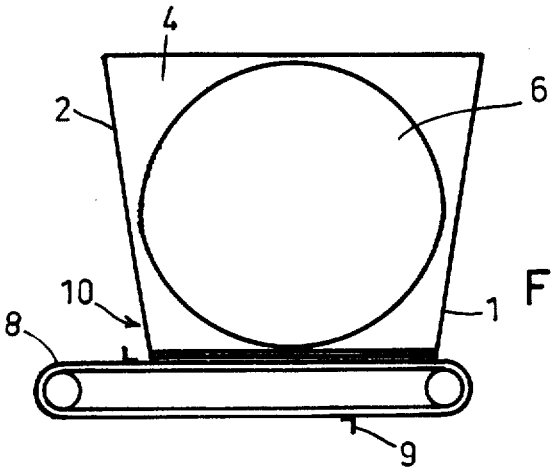
FIG. 2 is an elevation of the orientation apparatus of FIG. 1 as viewed from the side, where billet discharge is to the left.
Figure 3:
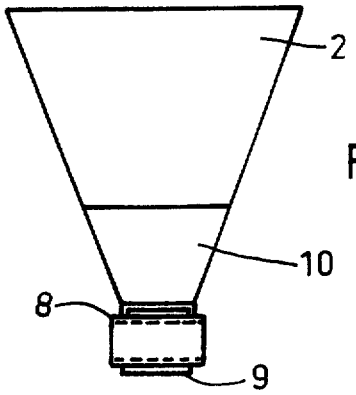
FIG. 3 is an end elevation of the orientation apparatus of FIG. 1 when viewed from the billet discharge end.

Referring to the FIGS. 1, 2 and 3, the orientation device consists of the following two basic parts: a hopper section comprising walls 1 to 4 and discs 5 and 6 in FIG. 1, and a conveyor section comprising a conveyor 8 and a plurality of vanes 9 in FIG. 2 and FIG. 3.

The hopper is a rectangular container made up of four adjoining walls 1 to 4 in FIG. 1, which converge to form a rectangular output region, the minimum dimension of which is shorter than the length of the shortest billet and the maximum dimension of which is longer than the length of the longest billet.

The walls 3 and 4 in FIG. 1 each include a rotating disc 5 and 6 respectively, to which are attached a number of billet agitator vanes 7. Discs 5 and 6 rotate in opposite directions to one another.

The conveyor 8 is of the endless belt type, and is positioned directly beneath the hopper output region. Affixed to the conveyor 8 are a plurality of transverse vanes 9.

A billet output opening 10 is provided between the conveyor 8, the hopper wall 2.

In operation, billets in random orientation and in a continuous stream fall into the hopper of the orientation device. The counter rotating discs 5 and 6 with the agitator vanes 7 impart impulsive energy to the billets causing the billets to turn and enabling them to fall and pass into the rectangular region at the bottom of the hopper.

The billets which pass into the rectangular region then contact the moving conveyor 8, which, aided by the attached transverse vanes 9, imparts energy to the billets and causes them to change direction and move with the conveyor 8. Those billets which are not in the same plane as the conveyor 8 are directed towards this plane by the energy imparted to them by the conveyor 8 and the vanes 9 and the effect of gravity on the billets.

The billets are carried by the conveyor 8 out of the hopper through the output opening 10 in a substantially orientated conformation.

The walls 1 and 2 form passive energy sources whilst the discs 5 and 6, the vanes 7, the conveyor 8 and the vanes 9 form active energy sources.

An air blast system shown in FIGS. 4 and 5 combines both active and passive energy sources and consists of a circular conical funnel 11 with its larger opening forming the billet input opening 12 and being positioned above the smaller billet output opening 13. A plurality of rectangular spaced apart slots 14 are formed in the funnel 11 such that each slot 14 is orientated towards the output opening 13 of the funnel 11. Each slot 14 has a deflection flap 15 projecting from one of the longer sides of the slot. FIG. 5 shows a close up view of one slot 14 and the corresponding deflection flap 15.

The funnel 11 is surrounded by a sealed cylindrical housing 16 which is connected to a means for supplying compressed air (not shown) via an air supply pipe 17.

In operation a continuous blast of air enters the funnel 11 from the housing 16 through the slots 14. The deflection flaps 15 are angled such that the sum of all the air blasts produces an air blast vortex. The axis of this vortex coincides with the axis of the funnel 11.

As the random stream of billets fall into the funnel 11, the sides of the funnel 11, the deflection flaps 15, and the air blast vortex all co-operate to compress the billets towards the central funnel axis and orientate the billets so that their axes are all vertical.

The diameter of the output opening 13 determines the maximum throughput volume of billets able to be orientated by the apparatus without choking the funnel 11.

A hopper 18 shown in FIG. 6 has a rectangular cross-section and is formed by two substantially parallel vertical walls 19 and 20 separated by two inwardly sloping rectangular walls 21 and 22 that converge towards an output opening 23. The opening 23 is rectangular having the longer side longer than the longest billet and the shorter side shorter than the shortest billet. The sloping walls 21 and 22 provide a passive source of impulsive energy. Situated in, and flush with, the sloping walls 21 and 22 are two rotating discs 24 and 25 that provide an active source of impulsive energy. Attached along a diameter of each disc 24 and 25 and projecting inwardly therefrom are rectangular vanes 26. The discs 24 and 25 are positioned to project slightly beyond the output opening 23, as best seen in FIG. 7, and are rotated in opposite directions such that, in cooperation with the sloping walls 21 and 22, billets falling into the hopper 18 are orientated to lie in the direction of the longer side of the output opening 23.

While the rotating vanes 26 prevent billets choking the output opening 23 by jamming across same, the area of the opening 23 determines the maximum throughput volume of billets which will not choke the hopper 18.

Figure 8:
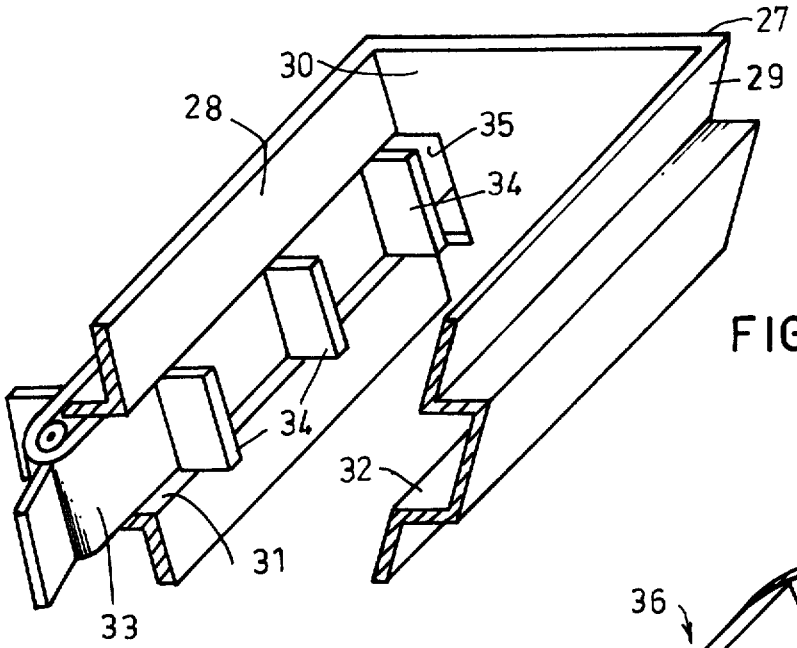
FIG. 8 is a perspective view of the orientation apparatus of an example, one end wall of the apparatus being removed to reveal the interior.

Referring now to FIG. 8 a hopper 27 having a rectangular cross-section with sloping side walls 28 and 29 and a vertical end wall 30 is shown. The remaining end wall has been removed to reveal the interior of the hopper 27. Formed in each sloping wall 28 and 29 is a horizontal recess 31 and 32 respectively.

A continuous flexible belt 33 is positioned in recess 31. An identical belt is provided for recess 32; however this belt is not shown in FIG. 8 to simplify the diagram. Attached along the length of the belt 33 and projecting therefrom are a plurality of rectangular transverse vanes 34. The flexible belt(s) 33 carry the vanes 34 through openings 35 in the vertical walls 30 and along the recesses 31 and 32 in the inner surface of the sloping side walls 28 and 29. The belt(s) 33 are powered by drive motors (not shown) located outside of the hopper 27.

The belt(s) 33 are driven in opposite directions and the vanes 34 strike the billets of a stream of randomly orientated billets falling into the hopper 27. Under the influence of the vanes 34 the billets are orientated to lie in vertical planes perpendicular to the end wall 30. The majority of the billets will have their axes parallel to the lower edges of the sloping side walls 28 and 29. The distance between the lower edges of the sloping side walls 28 and 29 is less than the length of the shortest billet and the length of the sloping side walls 28 and 29 is greater than the length of the longest billet.

Figure 9:
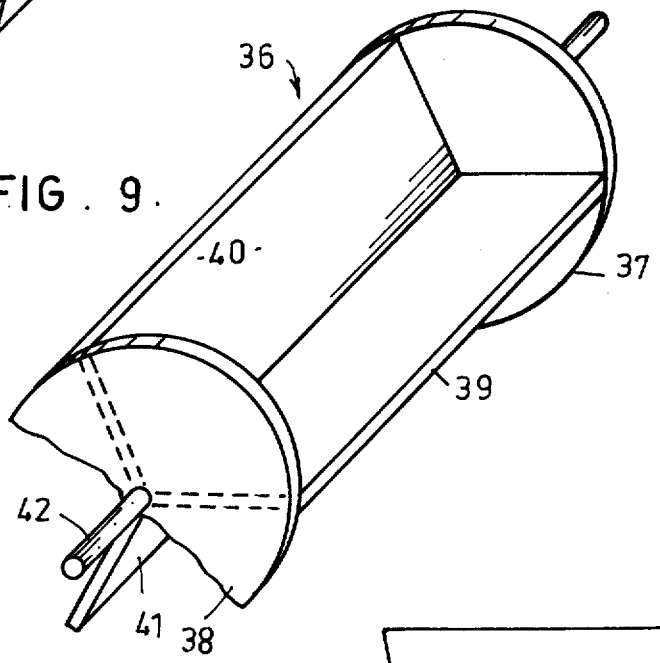
FIG. 9 is a perspective view of an example of a rotatable bundler paddle wheel orientation means.

FIG. 9 shows another orientation means comprising a rotatable bundler paddle wheel 36. The paddle wheel 36 consists of three paddle vanes 39, 40 and 41 respectively attached to and radially projecting from a central axle 42. Two circular discs 37 and 38 are attached to the ends of the vanes 39, 40 and 41 and are perpendicular to them. The axle 42 passes through the centre of both discs 37 and 38. The disc 38 has been partly cut away to reveal the vane 41. The discs 37 and 38 and the vanes 39, 40 and 41 together form three rotatable compartments. In operation the random stream of billets fall into the rotating compartments and the slope of the walls of these compartments plus the fact that these sloping walls also act as moving directors operate to orientate the billets such that the axes of the billets are parallel to the axis 42 of the paddle wheel 36. The billets are of course continuously discharged from these compartments to fall parallel into the bin.

The rotational velocity of the paddle wheel determines the maximum throughput volume of falling billets and the paddle wheel could be constructed to have any number of compartments.

Figure 10:
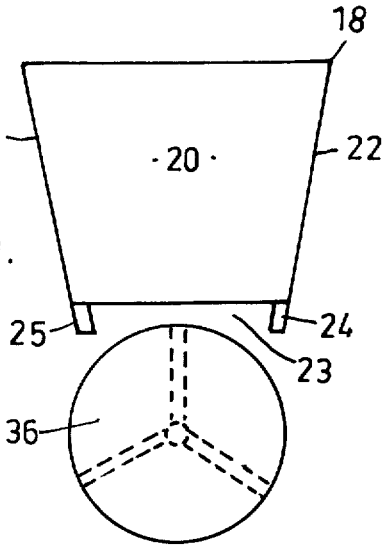
FIG. 10 is an end elevation of an example showing the bundler paddle wheel positioned below the orientation apparatus of FIGS. 6 and 7.
Figure 11:
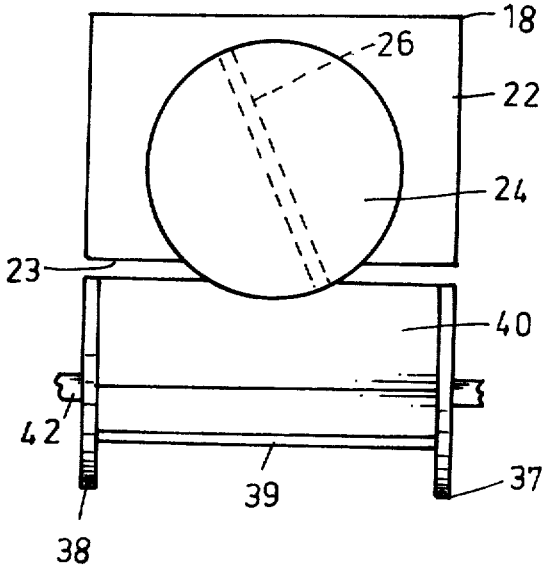
FIG. 11 is a side elevation of the example of FIG. 10.

FIG. 10 shows the paddle wheel 36 of FIG. 9 positioned directly below a hopper 18 of rectangular cross-section as illustrated in FIG. 6. Paddle vanes 39 and 40 as shown in FIG. 11 extend parallel to the longer walls 21 and 22 of the rectangular output opening 23 of the hopper 18 such that each paddle wheel compartment can be rotated to receive all the billets passing through the opening 23.

In operation the falling stream of random billets entering the hopper 18 are subatantially orientated as they pass through the hopper 18 and are further orientated as they fall into a first paddle compartment. When the first compartment is full the paddle wheel 36 rotates in a clock-wise direction as seen in FIG. 10 thus discharging the billets contained therein into one end of the bin (not shown) positioned underneath the paddle wheel 36. At the same time an empty second compartment is moved into position under the opening 23.

When this second compartment is full the paddle wheel 36 rotates in a counter-clockwise direction as seen in FIG. 10 thus discharging the billets into the other end of the bin (not shown). In this embodiment the paddle wheel 36 oscillates to spread bundles of orientated billets to the one end and then the other end of the bin thereby stacking the bin in an orderly manner reducing the space between adjacent billets and increasing the carrying capacity of the bin.

Figure 12:
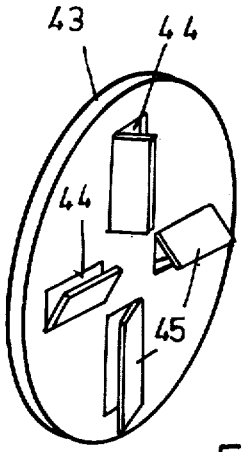
FIG. 12 is a perspective view of an alternative embodiment of the disc illustrated in FIGS. 1, 2, 6, 7, 10 and 11.

FIG. 12 shows a disc 43 which may be used in place of the discs 24 and 25 in FIGS. 6, 7, 10 and 11. The disc 43 has a plurality of slots 44 each of which is partially covered by a vane 45. The disc is rotated in a counter-clockwise direction as viewed in FIG. 12 and the discs on either side of the hopper rotate in opposite directions.

The vanes 45 on the disc 43 form the blades of a fan and as the disc 43 is rotated air is drawn into the hopper through the slots 44. This flow of air and the moving vanes 45 perform the same operation as the vanes 26 in FIG. 6 by orientating the falling billets. In addition the flow of air assists the removal of any trash associated with the billets.

Figure 13:
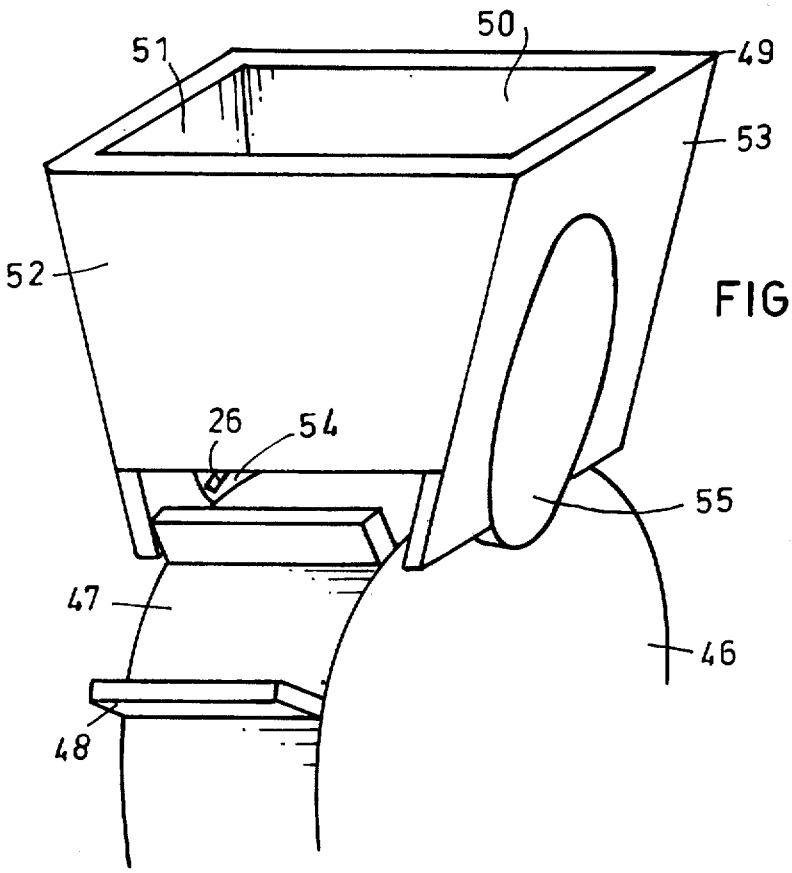
FIG. 13 is a perspective view of an example of an orientation apparatus including a rotary drum conveyor means.

Referring now to FIG. 13 a drum 46, having a plurality of transverse vanes 48 mounted on the cylindrical surface 47 of the drum 46, is mounted beneath a hopper 49. The hopper 49 has a rectangular cross-section formed by two sloping walls 51 and 53 and two vertical walls 50 and 52. Walls 51 and 53 have discs 54 and 55 which are similar to the discs 24 and 25 illustrated in FIG. 6. Both discs 54 and 55 have a vane 26 as illustrated in FIG. 6.

In operation the drum 46 rotates in a counter-clockwise direction as viewed in FIG. 13 and the discs 54 and 55 rotate in opposite directions. The sloping walls 51 and 53 and the rotating discs 54 and 55 orientate a random stream of billets falling into the hopper 49 so that the billets generally lie within vertical planes which are perpendicular to the walls 50 and 52. In these planes however the billets are randomly orientated until they strike the moving surface 47 and the vanes 48. The billets are thereby orientated to lie tangential to the surface 47 of the drum 46 the axes of the billets being substantially perpendicular to the walls 50 and 52.

The billets are thus orientated to be parallel to the direction of movement and are carried out of the hopper 49 under the wall 52 by the drum 46. In this embodiment of the invention not only does the orientation means bring about the desired orientation but the orientation means also causes the orientated billets to move in a direction different from that of the original stream of falling billets.

The foregoing describes some embodiments of the present invention and modifications, obvious to those skilled in the art, may be made thereto without departing from the scope of the present invention.

I claim:

1. Apparatus for urging into a first orientation plane elongated billets having lengths within a predetermined range of lengths and falling under the influence of gravity in a randomly orientated stream of billets into the apparatus, said apparatus comprising a hopper having an open top, an open bottom, two side walls and two shorter end walls with at least said side walls converging toward said open bottom, the shortest distance between said side walls and the shortest distance between said end walls being respectively less than the shortest billet and longer than the longest billet in said predetermined range of billet lengths; a primary orientating means comprising two rotatable discs located between said hopper top and bottom, one in each side wall and generally co-planar therewith; at least one billet orientating vane on each said disc projecting into said hopper; and driving means to rotate the discs in opposite directions.

2. The apparatus as claimed in claim 1 including secondary billet orientation means to accept said billets lying in said first orientation plane and to urge said billets into a second mutually perpendicular orientation plane, said secondary billet orientation means being located adjacent to and below said hopper bottom and comprising a conveyor having spaced-apart transverse vanes, the distance between consecutive vanes being greater than or at least equal to the longest billet in said predetermined range of billet lengths.

3. The apparatus as claimed in claim 1 including secondary billet orientation means to accept said billets lying in said first orientation plane and to urge said billets to also lie in a second mutually perpendicular orientation plane, said secondary orientation means being located adjacent to and below said hopper bottom and comprising a three compartment receptacle oscillatable about an axis lying in the first orientation plane to locate each compartment successively in a first position beneath said hopper outlet to receive billets discharged from said hopper, to urge said billets into said second orientation plane and to successively move said compartments from said first position to a second position to discharge substantially uniformly orientated billets from said receptacle.

4. Apparatus for urging into a first orientation plane elongated billets having lengths within a predetermined range of lengths and falling under the influence of gravity in a randomly orientated stream of billets into the apparatus, said apparatus comprising a hopper having an open top, an open bottom, two side walls and two shorter end walls with at least said side walls converging toward said open bottom, the shortest distance between said side walls and the shortest distance between said end walls being respectively less than the shortest billet and longer than the longest billet in said predetermined range of billet lengths; a primary orientating means to urge said billets into a first orientation plane, said primary orientation means comprising two rotatable discs located between said hopper top and bottom, one in each side wall and generally co-planar therewith; at least one billet orientating vane on each said disc projecting into said hopper; driving means to rotate the discs in opposite directions; secondary billet orientating means to urge said billets to lie in said first orientation plane and a second mutually perpendicular orientation plane, said secondary billet orientating means being located adjacent to and below said hopper bottom and comprising a conveyor having spaced-apart transverse vanes, the distance between consecutive vanes being greater than or at least equal to the longest billet in said predetermined range of billet lengths.

* * * * *